US010072860B2

(12) United States Patent
Richards

(10) Patent No.: US 10,072,860 B2
(45) Date of Patent: Sep. 11, 2018

(54) CENTRALIZED FRESH AIR COOLING SYSTEM

(71) Applicant: Mike Richards, Anaheim, CA (US)

(72) Inventor: Mike Richards, Anaheim, CA (US)

( * ) Notice: Subject to any disclaimer, the term of this patent is extended or adjusted under 35 U.S.C. 154(b) by 818 days.

(21) Appl. No.: 13/776,518

(22) Filed: Feb. 25, 2013

(65) Prior Publication Data

US 2014/0242898 A1 Aug. 28, 2014

(51) Int. Cl.
*F24F 7/04* (2006.01)
*F24F 11/00* (2018.01)

(52) U.S. Cl.
CPC ..... *F24F 7/04* (2013.01); *F24F 11/0001* (2013.01); *F24F 2011/0006* (2013.01)

(58) Field of Classification Search
CPC ..... F24F 7/04
USPC ..... 454/237
See application file for complete search history.

(56) References Cited

U.S. PATENT DOCUMENTS

| | | | | |
|---|---|---|---|---|
| 2,188,566 | A | 1/1940 | Cowderoy-Dale | |
| 2,564,215 | A | 8/1951 | Slane | |
| 3,882,928 | A | 5/1975 | Gazzo | |
| 3,946,575 | A | 3/1976 | Barr et al. | |
| 4,201,121 | A * | 5/1980 | Brandenburg, Jr. | 454/250 |
| 4,410,131 | A | 10/1983 | Radtke et al. | |
| 4,662,269 | A * | 5/1987 | Tartaglino | 454/255 |
| 4,676,073 | A | 6/1987 | Lawrence | |
| 4,776,385 | A | 10/1988 | Dean | |
| 4,986,469 | A | 1/1991 | Sutton, Jr. | |
| 5,131,887 | A * | 7/1992 | Traudt | 454/255 |
| 5,362,273 | A * | 11/1994 | Pfeiffer et al. | 454/63 |
| 5,467,919 | A * | 11/1995 | Tamblyn | 236/49.3 |
| 5,902,183 | A | 5/1999 | Sutton, Jr. | |
| 6,439,466 | B2 | 8/2002 | Fikes | |
| 6,749,125 | B1 * | 6/2004 | Carson et al. | 236/49.3 |
| 6,752,713 | B2 * | 6/2004 | Johnson, Jr. | 454/186 |
| 7,222,494 | B2 | 5/2007 | Peterson et al. | |
| 7,398,821 | B2 * | 7/2008 | Rainer et al. | 165/247 |
| 7,497,774 | B2 * | 3/2009 | Stevenson et al. | 454/354 |
| 7,798,418 | B1 | 9/2010 | Rudd | |
| 8,079,898 | B1 * | 12/2011 | Stevenson | 454/328 |
| 8,152,608 | B1 * | 4/2012 | Hamby | 454/251 |
| 8,185,244 | B2 | 5/2012 | Wolfson | |
| 2004/0253918 | A1 * | 12/2004 | Ezell et al. | 454/239 |

* cited by examiner

*Primary Examiner* — Steven B McAllister
*Assistant Examiner* — Samantha Probst
(74) *Attorney, Agent, or Firm* — Kirk A. Buhler; Buhler & Associates

(57) ABSTRACT

A centralized fresh air cooling system that operates with outside air that vents inside house air into the attic of a house or building. A damper redirects air from the output of the central air circulator to the attic area to blow the hot attic air out of an attic. A typical central air circulator can replace the air within a house or building five to ten times an hour. They system can be retrofit to most central air systems by replacing the thermostats and installing the damper between the air circulator and the house or building ducting. Outside cooler air is drawn in windows or other openings in house or building, into the air circulator returns and then into the attic. The system uses multiple sensors and control mechanism to ensure optimal energy savings.

13 Claims, 4 Drawing Sheets

CENTRALIZED FRESH AIR COOLING SYSTEM

CROSS REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements and energy savings in house cooling. More particularly, the present house cooling system uses an existing forced air unit to draw air into the furnace return and exhaust the air into the attic to draw cold air into a house, remove hot air from within the house and push hot air out of the attic. The system uses one or more dampers to redirect the air to the house ducts or the attic.

Description of Related Art Including Information Disclosed Under 37 CFR 1.97 and 1.98.

Most houses use either an air conditioning system to cool a house, or attic fan that draws air in from the outside and through the house. In many cases a home owner will operate an air conditioning system while the outside temperature is colder than the air within a house. This results in a waste of electricity. Some homeowners recognize the difference in the temperature and will manually shut off the air conditioning and open windows to cool a house with free cooler outside air. Many others open an attic and use a fan to draw the house air through the attic opening. Some patents have been issued that either operate air conditioning systems, whole house fans, or systems that air condition different rooms at different times of the day. These systems require the house to be built or significantly modified to operate. Exemplary examples of house air conditioning systems are disclosed herein.

U.S. Pat. No. 4,676,073 issued Jun. 30, 1987 to Carl Lawrence, U.S. Pat. No. 5,902,183 issued May 11, 1999 to Melanius D'Souza and U.S. Pat. No. 4,986,469 issued Jan. 2, 1981 to James A. Sutton Jr. all disclose an air circulation system that turn on or off fans to move outside air through an enclosure. These fans use inside/outside temperature sensor or time-of-day timers to operate the fans. While these patents disclose an air circulation system that ventilates a building with outside air the systems do not work with forced air unit to achieve energy savings.

U.S. Pat. No. 3,946,575 issued Mar. 30, 1976 to Russell L. Barr et al and U.S. Pat. No. 4,776,385 issued Oct. 11, 1988 to Arthur C. Dean both disclose a house air conditioning system that opens and closes ducting to use outside air.

These patents require the house to be pre-built with the ducts to alter where air is drawn through a building. The use of ducting further eliminates the possibility that outside air can naturally be blown through a building or house without any fans using the wind or thermal vertical movement of air.

U.S. Pat. No. 7,222,494 issued May 29, 2007 to Mark W. Peterson et al discloses an Adaptive Intelligent Circulation Control Methods and Systems. This system also requires a house or building to be constructed with ducting for outside air. The system has a number of sensors located both inside and outside of the house to improve the comfort within the house and reduce energy costs. The system can operate under a user defined program or in random sequence.

What is needed is a system that operates with a pre-constructed house and existing forced air unit. The forced air unit draws air into the furnace return and exhausts the air into the attic to draw cold air into a house, remove hot air from within the house and push hot air out of the attic. The system uses one or more dampers to redirect the air to the house ducts or the attic. The proposed application provides these functions in a system that can be retrofit to operate with an existing forced air unit.

BRIEF SUMMARY OF THE INVENTION

It is an object of the centralized fresh air cooling system to reduce the total time that an air conditioning system needs to run to provide the same comfort all day. This is accomplished by automatically altering the air flow from the air outlet vents to the attic. When the outside air is cooler than the inside air. The "free" cooler outside air is drawn from the outside into the house through the forced air system of a house and into the attic. The hot attic air is then blown out through the attic vents. Lowering the attic temperature cools the overall house temperature.

It is an object of the centralized fresh air cooling system to allow a house air conditioner to spend less time running nonstop, and more running in cycles which provides overall better efficiency of electricity. The reduction in air conditioning usage will increase air conditioner life span since it reduces system strain. The reduction of electricity use will also reduce energy procurement costs during peak demand hours, so it will result in lower costs for all. The reduced demand for electricity will reduce energy generation impact on environment. The centralized fresh air cooling system can exchange all of the air in a house five to ten times an hour at a fraction of the cost of running a typical air cooling system.

It is another object of the centralized fresh air cooling system to include automatically operated dampers that use the house thermostat settings with outside temperature readings to operate the system. The system is connected into a house or building with modification to the forced air unit that adds the dampers. The thermostat is also changed to accommodate the additional features of the system. The system can operate with or without the presence of the occupants and the fresh air cooling process can automatically operate while the residents of occupants are away. This is particularly useful when the occupants are away and a house is warming throughout the day, but the occupants want the house aired out or cooled prior to arrival.

It is another object of the centralized fresh air cooling system for the system to run in three modes remote, automatic, or manual. The outside to attic venting can be switched off so the thermostat can operate as an ordinary programmable thermostat.

It is still another object of the centralized fresh air cooling system for the system to allow natural air evacuation process can be started via setting programmable timer in the thermostat reducing the arrival temperature and reducing the time the air conditioner will need to run to achieve desired temperature.

It is another object of the centralized fresh air cooling system to operate with any existing basic air conditioning/heating system that currently uses a central air thermostat. The system connects sensors with controls for fans, actuators, servos or actuators or diverters using communications over pre-existing power lines and or a wireless network to simplify installation.

Various objects, features, aspects, and advantages of the present centralized fresh air cooling system will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
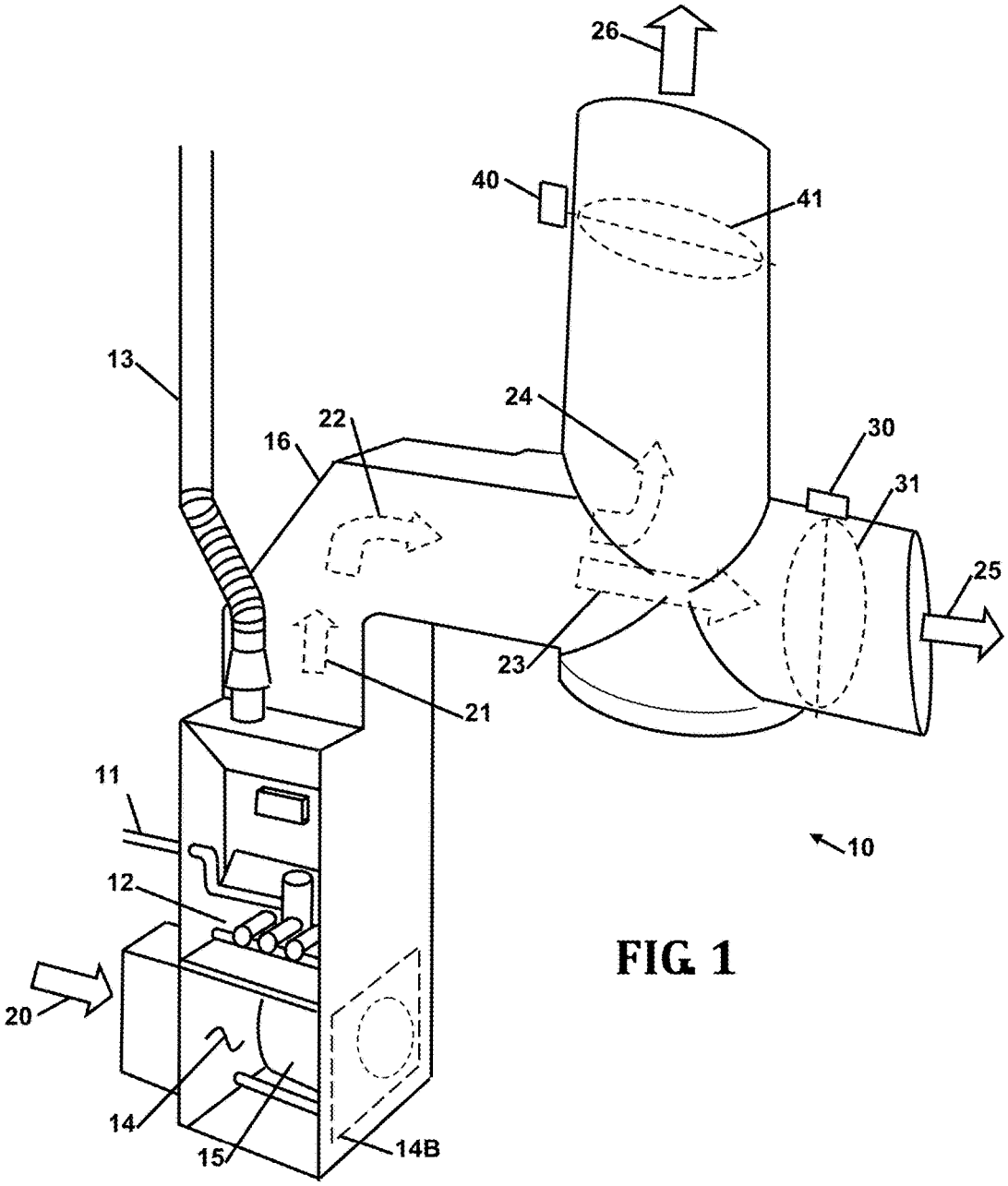
FIG. 1 shows a perspective view of a forced air unit with the directional diverter installed.

FIG. 1 shows a perspective view of a forced air unit with the directional diverter installed 10. The embodiment shown, provides one contemplated arrangement of the components, but other orientations and configurations are contemplated that would provide equivalent functions. The basic forced air unit is unchanged where air 20 enters into the forced air unit, a gas line 11 provides a fuel source for a combustion heater 12 to warm air 21 that is recirculated 25 back into a house or building. Exhaust pipe 13 vents burned fuel to outside of the residence or building.

The installation of the fresh air cooling system requires a diverter to be added after the forced air unit and the control unit is replaced. In the preferred embodiment, air 20 is drawn into the forced air unit from the return(s) of the house or building. A filter 14 cleans the air to prevent combustible material from entering the forced air unit where it can be a fire hazard or blow dirt through the forced air unit and duct and then back into a house or building. When turbo fan is being used a second air filter 14B can be incorporated to increase the amount of air that can be drawn through the fan 15. A squirrel cage, turbo fan, variable speed fan or similar fan 15 draws air 20 in from the returns and then blows the air through the heating and or cooling chamber 21. The forced air unit can generally operate in a fan only mode where neither heating nor cooling is applied to the air being moved through the forced air system. Ducting 16 then redirects the flow of the air through a plenum or ducting system into a house or building.

In the preferred embodiment a directional diverter allows air to flow back into the house 23 and 25 when damper 41 is closed or into the attic or other area 24 and 26 when damper 31 is closed. A motor or actuator(s) 30 and 40 operated the dampers 31 and 41 respectively. While separate dampers and actuators are shown for each of the ducting directions 25 and 26, it should be understood that a single damper that is controlled by a single actuator, servo or motor that closes either duct. When the dampers direct air into the attic 26, the forced air unit is not acting in a closed recirculation mode. Because the air is not recirculated through a house or building, fresh air is drawn out of the house and into the attic where the hot attic air is blown out of the attic. The air within the house is typically exchanged five to ten times per hour. This is shown and described in more detail with FIG. 4.

Figure 2:
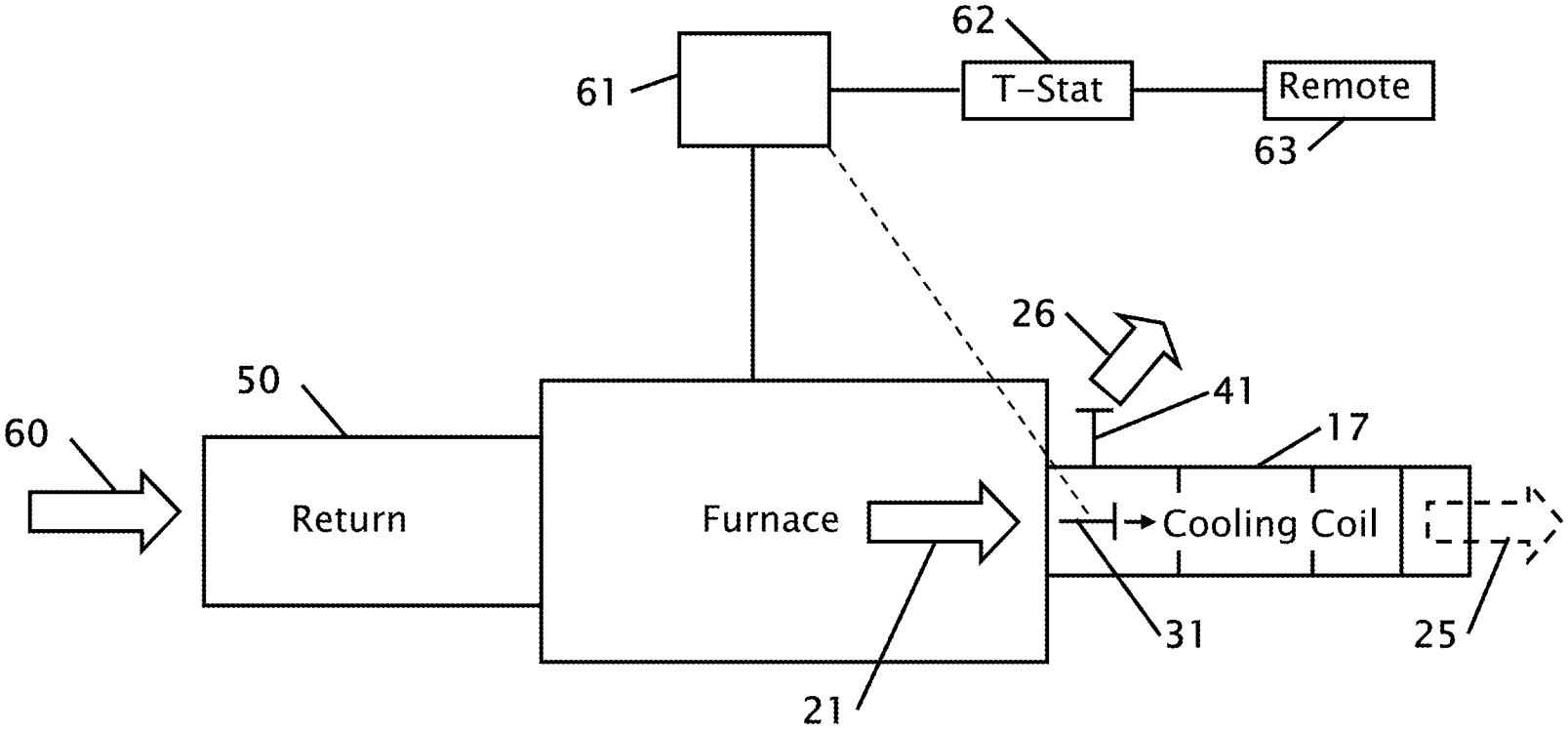
FIG. 2 shows a block diagram of the centralized fresh air cooling system.

FIG. 2 shows a block diagram of the centralized fresh air cooling system. In the evenings the outside temperature is typically cooler than the air that is trapped within a house. When the centralized fresh air cooling system is operated, cooler outside air 60 is drawn into the return 50 of the forced air unit, through the forced air unit 21 and past the heating and cooling coils 17 and into the house ducting 25. An Integrated Control System 61 operates with residential or building central heating and or cooling systems to call for a heating function, cooling function, or fresh air function. The Integrated Control System 61 operates dampers 31 and 41 to control the air flow direction depending upon the desired function. The controls can use the inside and outside temperatures to determine the most cost effective operation based upon the existing temperatures or projected temperatures based upon weather conditions or time of day. The Integrated Control System receives reading from the T-Stat 62 that are wired or wireless. A remote control 63 allows operation of the system at a location that is distant from a wall mounted master control.

Figure 3:
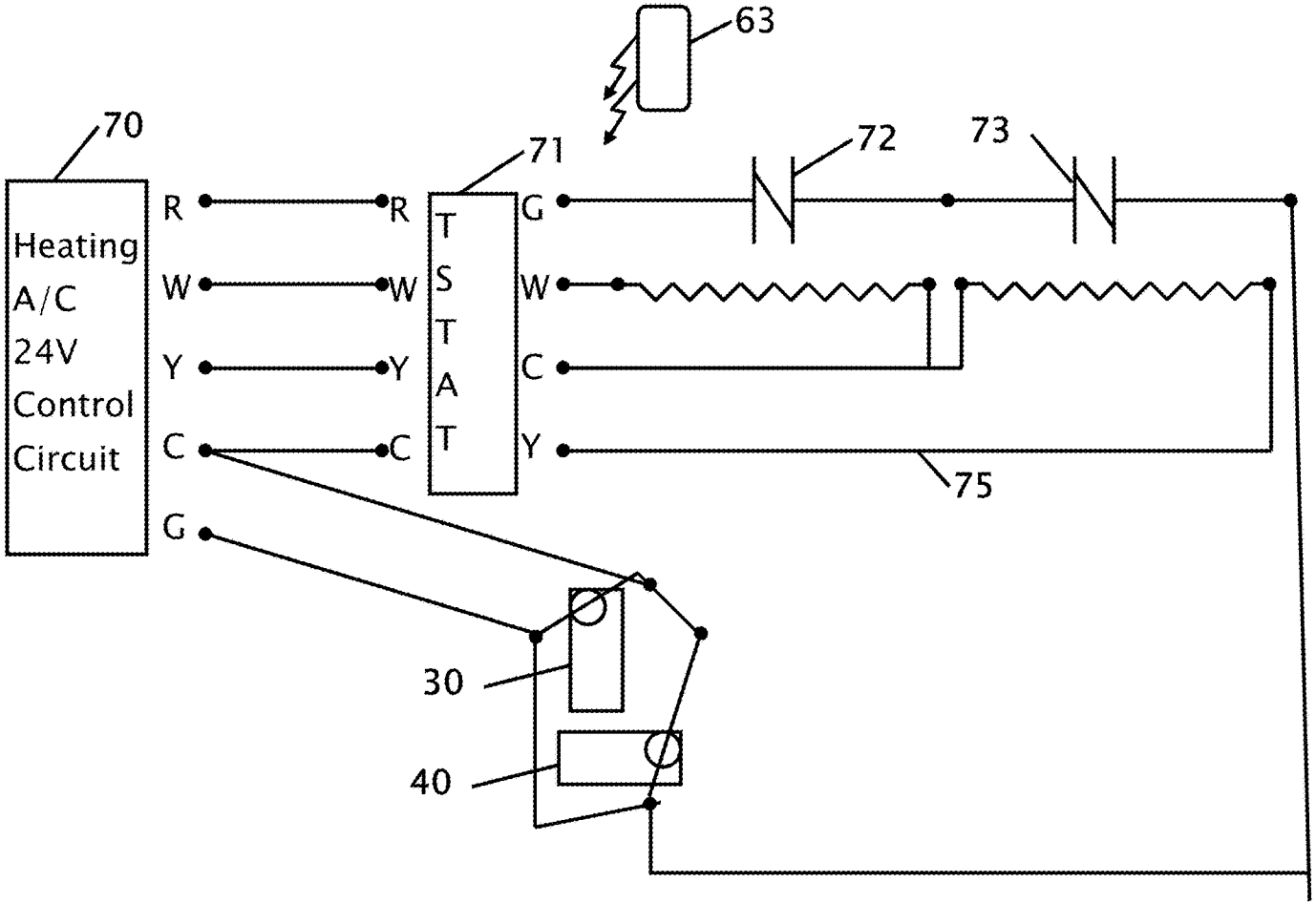
FIG. 3 shows a single line ladder wiring diagram for the econo-air centralized fresh air cooling system.

FIG. 3 shows a single line ladder wiring diagram for the econo air centralized fresh air cooling system. The wiring, wire colors and connections are typical of HVAC system wiring, and the installation of the centralized fresh air cooling system requires minimal rewiring of the existing HVAC wiring. A transformer (not shown) provides 24 VAC for logic and control to the control circuit 70. The T-Stat 71 receives temperature readings from inside and outside of the building or residence as a wired or wireless remote 63 signal. The integrated control system works with the contacts 72, 73 of the existing forced air units to control the heating, air conditioning and fresh air functions. The motorized dampers 30 and 40 are opened and closed to direct the air flow in the desired direction. When there is a call for heating or cooling 75, Normally closed (N/C) contacts open to shut of fresh air and the system goes into normal heating and cooling modes. The centralized fresh air cooling system overrides the house or buildings heating and/or cooling system to ensure that the house or building heating and or cooling system does not operate to heat or cool the house or building while the fresh air cooling system is in operation.

Figure 4:
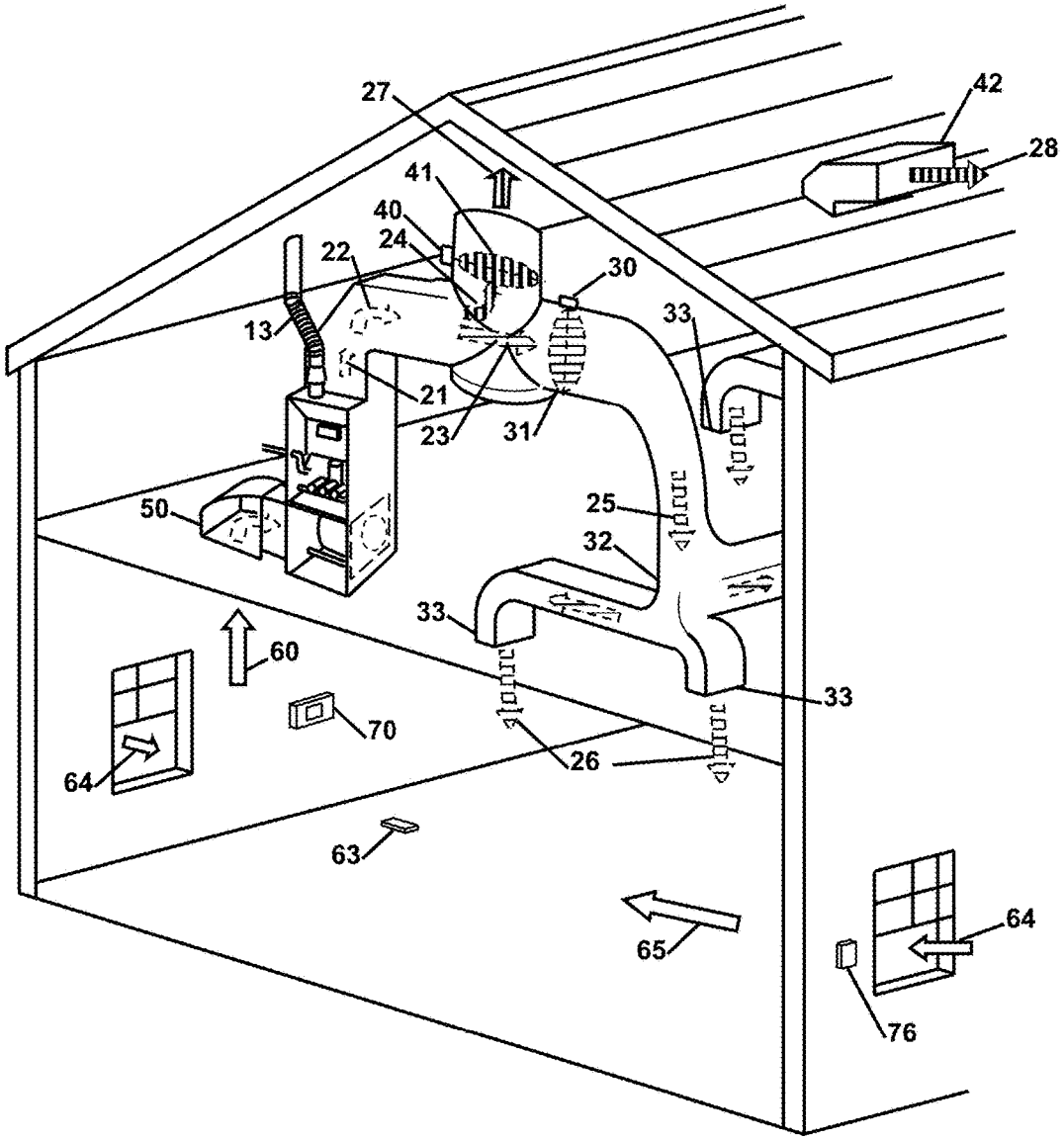
FIG. 4 shows a house with the centralized fresh air cooling system installed.

FIG. 4 shows a house with the centralized fresh air cooling system installed. Where the typical ducting 13 for furnace heating exhausts through the roof. In most newer homes a forced air unit is installed in the attic. The forced air unit draws air into the returns 60, through the forced air units 21, 22 and blows the air 23 through ducts 25 where the air is then distributed 32 out of vents 33 and into the house 26 for recirculation again through the house. On hot days the air with the attic of a house can increase significantly from radiation heating of the sun. This air often stagnates in the attic and reduces the efficiency of the air conditioning unit to cool the house. The centralized fresh air cooling system uses cool outside air 64, 65 to be drawn through windows, doors or other openings, where the air 60 is drawn into the plenum 50. The return is typically placed in the ceiling where hot air rises. The air from the return is then directed through 21 and 22 where the air 24 is directed into the attic 27. The air 27 then blows through the attic and out 28 roof vents 42 thereby cooling the interior space of both the house and the attic.

In this preferred embodiment, directional diverters allows air to flow back into the house 26 when damper 41 is closed by servo, actuator or motor 40, or into the attic or other area 27 and 28 when damper 31 is closed by servo, actuator or motor. While separate dampers and actuators are shown for each of the ducting directions 23 and 24, it should be understood that a single damper that is controlled by a single actuator, servo or motor that closes either duct. Moving air through the attic reduces humidity in the attic thereby drying the attic and living spaces in a home to reduce the chances of mold and mildew growing.

The wall mounted control unit 70 can be replaced or wired to operate the dampers when the fan only mode is selected. A wireless 63 or secondary remote control allows a person to operate the system at a location that is distant from the wall mounted control unit 70. An outside mounted temperature sensor 76 is used to prevent a user from opening windows where the outside temperature is in contrast to the desired heating or cooling that is desired. The remote can monitor temperature inside and outside temperatures and turn the system on and off from anywhere in a home. It is also contemplated that the unit can be controlled over a wired or wireless communication system such as with a cellular communication network or the internet. While the system is mostly described for cooling the interior of a house and attic, it is also contemplated that the system can be used when the outside temperature is warmer than the inside temperature, and the owner want to warm the inside of the house with warmer outside air, or simply exchange the inside air with outside air.

Thus, specific embodiments of a centralized fresh air cooling system have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A centralized fresh air cooling system comprising:

ducting within a house or building air circulation system with a single blower that circulates air completely within said house or building;

said house or building air circulation system having an inlet within an occupied area of said house or building that draws air from within said house or building;

said house or building further includes at least one window and/or door that opens;

said house or building air circulation system with said single blower having a first outlet port within said occupied area of said house or building within said centralized house or building air circulation system with said single blower;

said house or building air circulation system having a second outlet port located within an attic;

said house or building air circulation system having at least one roof vent that is connected to said house or building;

said ducting further includes at least one damper that directs air from said first outlet port to said second outlet port;

said air circulation system draws outside air through said window and/or a door of said house or building with said single blower, through said house or said building and into said inlet and out said second outlet port wherein air is not recirculated through said occupied area of said house or said building, but is exhausted out said at least one roof vent.

2. The centralized fresh air cooling system according to claim 1 wherein said outside air is drawn into said house or building when said at least one damper directs air into said attic.

3. The centralized fresh air cooling system according to claim 1 wherein said at least one damper is controlled by a mechanical actuator.

4. The centralized fresh air cooling system according to claim 1 wherein said at least one damper is controlled by a pneumatic actuator.

5. The centralized fresh air cooling system according to claim 3 wherein airflow from said house or building air circulation system into said occupied area of said house or building is blocked by said at least one damper.

6. The centralized fresh air cooling system according to claim 1 that further includes an ambient temperature sensor located outside of said house or building.

7. The centralized fresh air cooling system according to claim 1 that further includes a temperature sensor located within said house or building.

8. The centralized fresh air cooling system according to claim 1 that further includes a temperature sensor located within said attic.

9. The centralized fresh air cooling system according to claim 1 wherein said air circulation system operates when air that is outside of said house or building is colder when than air within said house or building.

10. The centralized fresh air cooling system according to claim 1 that includes at least a second damper.

11. The centralized fresh air cooling system according to claim 10 wherein said at least a first damper and said at least a second damper operate in unison to direct air flow from said inlet to either said occupancy area of said house or building or to said attic with said single blower.

12. The centralized fresh air cooling system according to claim 1 wherein said centralized fresh air cooling system is integrated onto an existing HVAC system.

13. The centralized fresh air cooling system according to claim 1 that further includes a wireless remote-control unit that allows an owner to operate said system.

* * * * *